United States Patent [19]

Albanese

[11] Patent Number: 4,801,175

[45] Date of Patent: Jan. 31, 1989

[54] CONVERTIBLE BENCH/TABLE

[76] Inventor: Victor A. Albanese, 5130 E. Charleston Blvd., Suite 306, Las Vegas, Nev. 89122

[21] Appl. No.: 157,078

[22] Filed: Feb. 11, 1988

Related U.S. Application Data

[63] Continuation of Ser. No. 920,661, Oct. 20, 1986, abandoned.

[51] Int. Cl.[4] ..... A47B 85/04

[52] U.S. Cl. ..... 297/124

[58] Field of Search ..... 297/124, 135

[56] References Cited

U.S. PATENT DOCUMENTS

| | | | |
|---|---|---|---|
| 1,757,960 | 5/1930 | Greenstreet | 297/124 |
| 1,792,737 | 2/1931 | Greenstreet | 297/124 |
| 1,951,960 | 3/1934 | Anduaga | 297/124 X |
| 2,530,785 | 11/1950 | Rocca | 297/124 X |
| 2,561,703 | 7/1951 | Koenig | 297/124 X |
| 2,922,463 | 1/1960 | Johnston | 297/124 |
| 4,615,559 | 10/1986 | Blondeau | 297/124 |

*Primary Examiner*—Philip C. Kannan

*Attorney, Agent, or Firm*—Brown, Martin, Haller & Meador

[57] ABSTRACT

A convertible picnic table has a table top which retracts pivotally to serve as a bench back. Adjustment of the table top attitude is effected by a slotted bracket having one end pivotally mounted to the table top, and a second end slidably mounted to a palm nut mounted on a horizontal frame member.

3 Claims, 2 Drawing Sheets

CONVERTIBLE BENCH/TABLE

This is a continuation application Ser. No. 920,661, filed Oct. 20, 1986, now abandoned.

BACKGROUND OF THE INVENTION

This invention relates to a furniture article which may be used as a bench or a table by adjusting the attitude of the table top to serve as a bench back. More particularly, the invention relates to a method of fastening the table top in either a horizontal or tilted position in such a manner that the table top is completely stable at any chosen attitude.

Picnic benches having table tops which pivot for use as a back for the bench have been well-known for many years. When configured in the table mode, two of these units may be placed back-to-back to form a full-sized picnic table having bench seats on each side. Examples of patents disclosing various embodiments of convertible bench/tables are as follows: Greenstreet, U.S. Pat. No. 1,792,737, Loosen, U.S. Pat. No. 2,481,935, Koenig, U.S. Pat. No. 2,561,703, Anderson, U.S. Pat. No. 2,882,957, Lakin, U.S. Pat. No. 2,959,209, McCaw, U.S. Pat. No. 2,506,606, Johnston, U.S. Pat. No. 2,922,463, and Lepper, U.S. Pat. No. 2,856,985. Most of these patents relate to the specific construction of the convertible bench/table, and are particularly concerned with the method by which the table top is pivoted into the bench back position, and the fastening apparatus for holding the table top in the desired attitude. In the past none of the designs have been commercially successful principally because the stop mechanisms to maintain the table top in a horizontal position have been either inadequately designed, or designed in such a manner as to create instability in the top due to wear and tear after a small amount of usage, or are of such complicated design as to be not economically feasible to manufacture on a commercial basis and keep the price of the bench on a competitive basis. The present invention provides a method of securing the table top in a horizontal position, regardless of whether or not the supporting ground is horizontal. The invention also provides a fastening mechanism which is completely secure and does not permit any wobble or play in the top when it is in the horizontal position.

Accordingly, it is an object of the present invention to provide a convertible table wherein the table top is movable between a horizontal position and a retracted position for use as a bench back, wherein the table top can be stopped at any desired angle between the horizontal and fully retracted position. It is another object of the invention to provide a continuously adjustable fastening mechanism for securing the table top at any desired attitude without permitting any looseness or play in the structure. It is yet a further object of the invention to provide a convertible table/bench which is easy to manufacture and simple to operate, and which can be shipped unassembled and readily put together by the user. These and other objects of the invention are achieved by the design of the convertible bench/table, an embodiment of which is hereinafter disclosed.

BRIEF SUMMARY OF THE INVENTION

A convertible bench/table has a pair of spaced frame supports which support a seat and a pivoted table top. The table top may be pivoted between a horizontal position and a retracted position in which it serves as a back for the seat. A slotted mounting bracket has one end thereof pivotally attached to a flange which depends perpendicularly from the table top, and another end slideably engaging a bolt which extends through a fixed horizontal portion of the frame member. A threaded palm nut is used to bind the mounting bracket to the horizontal strut, thereby fixing the attitude of the table top in a desired position.

BRIEF DESCRIPTION OF THE DRAWINGS

The invention is best understood with reference to the drawings, in which.

DESCRIPTION OF A PREFERRED EMBODIMENT

Figure 1:
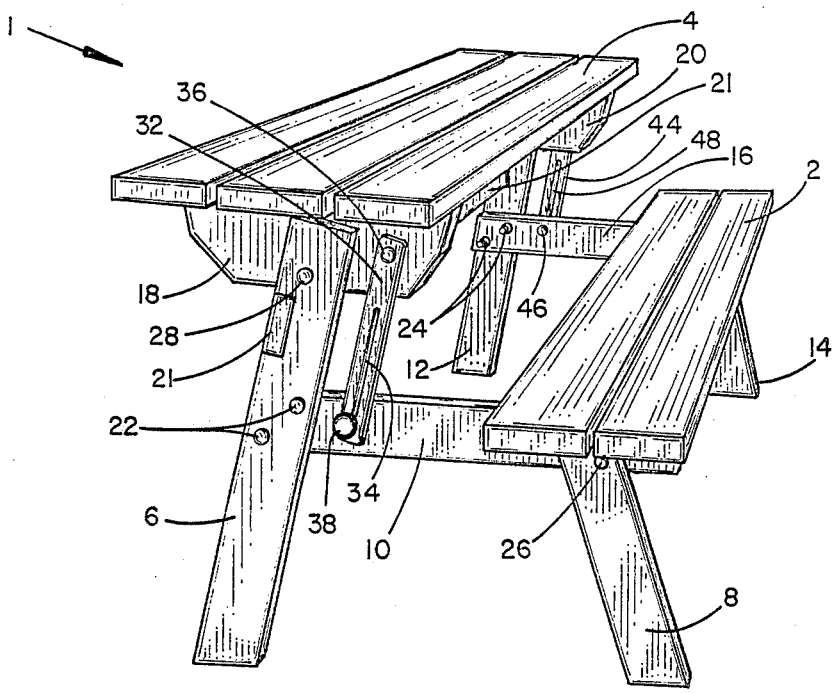
FIG. 1 is a perspective end view of the convertible table of the invention showing the table top in a horizontal position.

Referring first to FIG. 1, the convertible bench/table 1 has a horizontal seat 2 formed from two planks fixedly mounted to a pair of frame supports. A table top 4 which also serves as a bench back when the device is in the retracted attitude is formed from three planks mounted on a pair of transverse braces 18 and 20. The upper edge 5 of the brace supports the top (see FIG. 2). Although the elements in the drawings are illustrated as being wooden planks, it is to be understood that these elements may be formed of any suitable material and still be considered within the scope and spirit of this invention.

Figure 2:
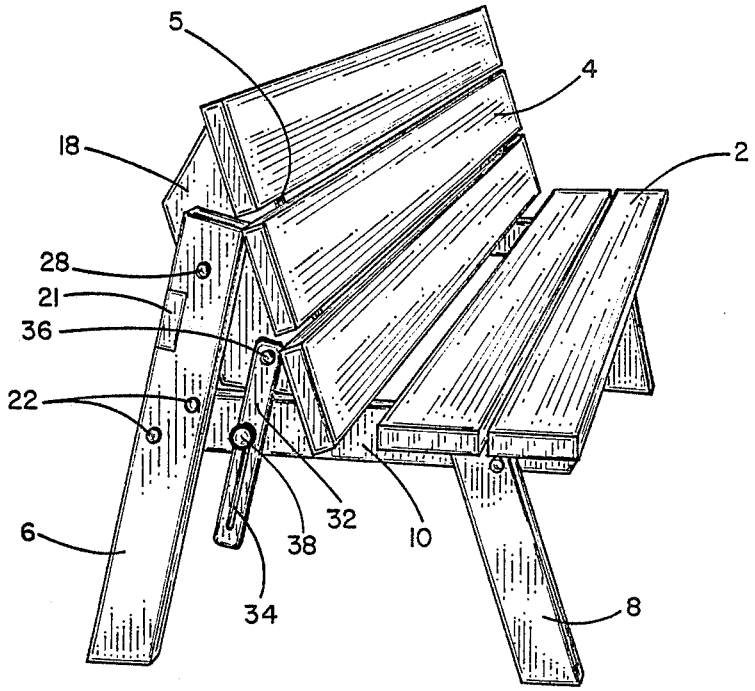
FIG. 2 is a similar view showing the table top in a retracted position for use as a bench back.

The seat and table top are mounted on a pair of identical spaced frame members which consist of a pair of legs fastened to a horizontal strut. As seen in FIGS. 1 and 2, a first frame member comprises a long rear leg or pedestal 6 mounted beneath the table top, and a forward shorter leg 8 mounted beneath the seat 2. The front and rear legs are angled outwardly from each other toward the ground, and are fastened to a horizontal mounting strut 10 by means of bolts 22 and 26. The second frame member is constructed from a rear leg 12, a forward leg 14, and a horizontal strut 16 in similar fashion to the first frame member. Bolts 24 fasten the other rear leg to the horizontal strut. Both frame members are rigid. Spacing between the rear legs is rigidly held uniform by a horizontal transverse member 21 attaached to each leg.

A pair of brace or flange members 18 and 20 depend perpendicularly and transversely from opposing ends of the table top 4. A central transverse spreader or strengthening member (not shown) may optionally be mounted beneath the top between braces 18 and 20.

The table top is pivotally mounted by a pair of bolts (see bolt 28 in FIGS. 1 and 2) which extend through the rear legs and the mounting flanges. While the table top can pivot freely about these bolts, the bores through the table top are cut to very close tolerance to preclude any play or movement around the bolt. The carriage bolt is of sufficient length to extend through both members and is secured with a flat washer, lock washer and hex nut.

Figure 4:
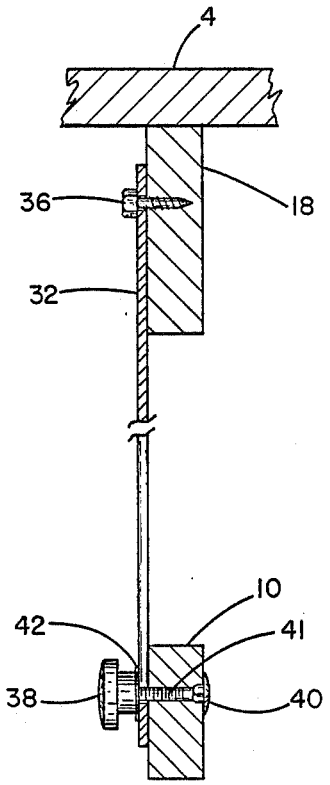
FIG. 4 is a partial section view showing the fastening mechanism of the invention.

The most important part of the invention involves the particular method used to fasten the table top at the desired attitude relative to the seat. A rigid metal bracket 32, consisting of a flat structural steel or aluminum strap having a longitudinal slot 34 extending along a portion of the length of the bracket, is mounted between the mounting flange 18 and the horizontal strut 10 which extends between the front and rear legs. The strap is approximately 12½" long and ⅛" thick, with a slot having a length of about 5" and a width of about 5/16". The top end of the bracket is pivotally mounted to the mounting flage by means of a hex-head 1" lag screw. The initial 3/16" of the screw adjacent the hex-head is unthreaded to permit rotation of the bracket around the screw. Details of the mounting bracket are best seen in FIG. 4.

The lower portion of the mounting bracket is removably secured to the horizontal strut 10 by means of a carriage bolt 40 which extends through a bore 41 in the strut 10. The carriage bolt 40 protrudes through the slot 34 in the mounting bracket and is secured by a threaded palm nut 38 and a circular washer 42. A similar mounting arrangement is located at the other end of the table, with mounting bracket 44 pivotally mounted to flange 20, and carriage bolt 46 extending through slot 48 in the bracket. While the drawings show a palm nut securing means at both ends of the table, the invention is entirely operable with a fastening mechanism at only one end.

Figure 3:
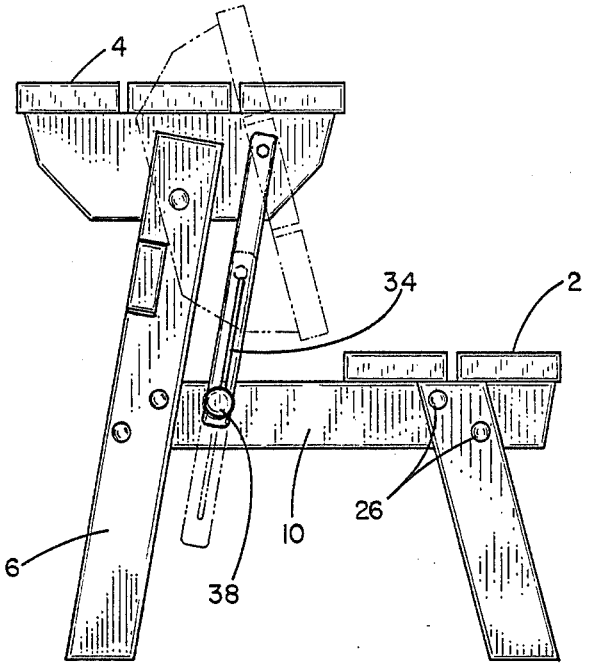
FIG. 3 is an end view of the table showing the retracted position in phantom.

FIG. 3 shows an end view of the table of the invention with the retracted (slot-back) attitude being shown in phantom. In addition, this Figure illustrates the advantage of the invention which permits the table top to be retracted to various attitudes between the two extreme positions. If the ground is slightly slanted, the table top may be maintained in a level position by simply sliding the bracket to the appropriate location to maintain the top horizontal. In addition, when the table top is used as a seat back as shown in FIG. 2 and in phantom in FIG. 3, the back may be adjusted at various attitudes to suit the desires of the user. Accordingly, the table top may be adjusted continuously at any desired angle between horizontal and fully retracted.

As is apparent from the drawings, the slotted brackets must be maintained in a vertical plane, and therefore the outer surface of the mounting flange and the outer surface of the horizontal strut are preferably in the same vertical plane. Accordingly, the legs 6 and 8 are also in the same vertical plane. The legs are preferably on the outside of the mounting flange and the horizontal strut, although the reverse situation is also operable.

The palm nut may be of any shape or size, but is preferably at least 1" in diameter and is preferably 1½" in diameter to permit an easy grip and to enable adequate tightening torque by the user. The face of the nut need not be round and may be configured for easy grapsing with a hand. This enables the nut to be tightened easily to preclude any movement whatsoever in the table top when it is placed in the horizontal position. In order to prevent any wobbling of the table, the bore in the flange which receives the hex-head screw 36 is machined without any tolerance to the same diameter as the screw.

Various modifications may be made to the convertible table/bench within the spirit and scope of the invention, which is directed principally to the particlar mounting bracket for fastening the table in any one of a continuous series of attitudes. Accordingly, the invention should not be considered limited by the preceding description of a preferred embodiment, but rather should be defined only by the following claims.

I claim:

1. A convertible bench-table apparatus comprising:

first and second spaced apart support frames, each frame support comprising a front leg member, a rear leg member which is taller than said front leg member, and a strut extending generally horizontally between said front and rear leg members and rigidly connected thereto in a non-pivoting manner by removable fasteners;

a seat spanning said support frames and secured to said struts at a position adjacent said front leg members;

a planar table top having first and second mounting flanges connected to an underside thereof and being spaced apart so that one flange is adjacent to each of said rear leg members;

mounting means for pivotally mounting each flange to a respective one of said rear leg members at an upper portion thereof;

at least one angular adjustment bracket having an elongated planar body with one end pivotally mounted to the first mounting flange and a longitudinal slot extending along a portion of its length; and clamping means for releasably gripping said adjustment bracket at selected positions along said elongated slot to enable continuous adjustment of an angular attitude of the table top from a horizontal position to a vertical position for use as a bench back, said clamping means comprising:

bolt means extending through the first frame support strut and the elongated slot, said bolt means being spaced apart from an associated rear leg member; and handle means having a manually rotatable body with a threaded aperture for interfacing with said bolt means.

2. The device of claim 1 further comprising:

second elongated bracket means having an end portion pivotally mounted to the second mounting flange, and having a second longitudinal slot extending along a portion of its length; and second clamping means for releasably gripping said second adjustment bracket at selected positions along said second elongated slot, said second clamping means comprising:

second bolt means extending through the second frame support strut and the elongated slot, said second bolt means bieng spaced apart from an associated rear leg member; and second handle means having a manually rotatable body with a threaded aperture for interfacing with said second bolt means.

3. The device of claim 1 wherein said removable fasteners comprise a pair of bolts extending through apertures in said struts and rear legs.

* * * * *